US008209773B2

(12) United States Patent
Bothwell

(10) Patent No.: US 8,209,773 B2
(45) Date of Patent: Jul. 3, 2012

(54) CONFIGURABLE SUPPORTIVE PROTECTION SYSTEM AND METHODS

(76) Inventor: Karen Bothwell, Bellevue, NE (US)

( * ) Notice: Subject to any disclaimer, the term of this patent is extended or adjusted under 35 U.S.C. 154(b) by 200 days.

(21) Appl. No.: 12/460,644

(22) Filed: Jul. 22, 2009

(65) Prior Publication Data

US 2011/0016606 A1 Jan. 27, 2011

(51) Int. Cl.
*A41D 1/20* (2006.01)
*A41D 1/22* (2006.01)

(52) U.S. Cl. ..... 2/104; 2/69; 2/73; 2/83; 2/105

(58) Field of Classification Search ..... None
See application file for complete search history.

(56) References Cited

U.S. PATENT DOCUMENTS 1,998,051 A 4/1935 Gerber
2,620,476 A * 12/1952 Kelsall ..... 2/74
4,031,566 A 6/1977 Johnson
4,144,593 A * 3/1979 Timmons ..... 2/104
4,458,365 A * 7/1984 Wood ..... 2/104
4,567,611 A * 2/1986 Kendrick ..... 2/104
4,698,848 A * 10/1987 Buckley ..... 2/114
4,964,173 A * 10/1990 Gordon et al. ..... 2/114
5,062,159 A * 11/1991 Jakub ..... 2/114
5,093,932 A 3/1992 Doyle
5,133,086 A * 7/1992 Truitt et al. ..... 2/114
5,259,068 A * 11/1993 Carroll ..... 2/104
5,946,722 A 9/1999 Trautmann
6,550,067 B2 * 4/2003 Force ..... 2/104
D495,468 S 9/2004 Wheeler-Dickson et al.
7,181,773 B1 2/2007 Piraka

* cited by examiner

*Primary Examiner* — Bobby Muromoto, Jr.
(74) *Attorney, Agent, or Firm* — Valauskas Corder LLC

(57) ABSTRACT

A configurable supportive protection system and methods comprising a sizeable support element and a coverage element that provide support and protection to human body parts. Advantageously, the system is quickly and easily configurable to allow body parts having different sizes to be supported. The system is selectively openable to thereby facilitate the maintenance of privacy and modesty of the patient during any activity.

18 Claims, 4 Drawing Sheets

CONFIGURABLE SUPPORTIVE PROTECTION SYSTEM AND METHODS

FIELD OF THE INVENTION

The present invention relates generally to a system and methods that provide support and protection during a range of activities. The present invention provides modesty protection and can support parts of the body during activities including those in which a patient is asked to engage such as medical tests. One preferred embodiment of the system provides support and protection to the breasts while still permitting quick and easy access to the torso and chest.

BACKGROUND OF THE INVENTION

A variety of garments are known by which particular areas of the body—breasts, scrotum, feet, legs, spine, etc.—can be supported during activities. However, largely all of these garments are not configurable to provide support to a wide range of sizes. Instead, a range of garments must be made available to accommodate different sizes. While such garments may provide modesty protection for the body part being supported, such protection is largely limited to only that body part.

Patients in hospitals, clinics, or doctors' offices are often provided with a garment to help protect their privacy and modesty during medical procedures such as treatments, tests or examinations. Such garments are typically shapeless, one-size-fits all drapes, the extent to which they cover the legs of the wearer depends on the height of the wearer. These drapes—commonly called gowns—open their entire vertical length. They can be worn such that the opening is along the front of the wearer or the back of the wearer. The opening is closable by a string—tieable such as by knotting the string—and/or through the use of snaps. The string tie ensures very little in the way of modesty protection since only the tied portion of the gown is typically closed. The snaps are often spaced such that large areas are easily exposed.

Medical procedures such as examinations often require that some part of the patient's body be exposed. The patient often seeks to keep the other parts of the body covered. For example, during a cardiac examination, a patient is usually subjected to frequent inspections of the chest area. Examples of cardiac examinations include an electrocardiogram test ("ECG" or "EKG"), echocardiogram test, or exercise stress test. During an electrocardiogram test, typically a nurse or technician places soft, sticky patches that form electrodes to the skin of the patient's chest, arms, and legs to monitor the heart's electrical activity from many angles to detect any weakness. An echocardiogram test sends ultrasound waves into the chest to create moving pictures of the heart to detect any irregularities. An exercise stress test, sometimes called a treadmill test, may further include an electrocardiogram test and monitors heart rate, breathing and blood pressure for any abnormalities during and after exercise.

During procedures that require the patient to move, many additional disadvantages, particularly for women, are associated with conventional gowns. Again, conventional gowns are largely only drapes—they fail to provide any support to portions of the body of the patient. The lack of support may cause pain and discomfort during those procedures that require exercise. Additionally, the pain and discomfort associated with the exercise may be mistakenly perceived as chest pain or create difficulty in discerning the intensity or location of any chest pain.

During medical procedures, the healthcare professional may need access to the chest to perform treatments, tests or examinations including the use of various medical procedure equipment. For example, during an electrocardiogram test a healthcare professional needs to access the chest to attach the electrodes. These include electrode wires. During an echocardiogram test, the patient is positioned on his or her side (usually the left side) to obtain pictures or images of the heart using an imaging device. Typically, these pictures or images must be obtained within a designated time frame such as 60-90 seconds post-test. Therefore, access to the chest must be quick and easy to work within this designated time frame.

Additionally, gowns failing to provide support to the body parts may cause displacement or even loss of connectivity of medical procedure equipment, for example, one or more electrodes in an electrocardiogram test or stress test. Displacement or loss of connectivity of medical procedure equipment may produce falsified results including, for example, artifacts on the imaging device.

It is conceivable that a patient may require immediate attention for unanticipated complications. When complications occur, healthcare professionals may need to remove the gown quickly and easily to access the chest to promptly administer a medical procedure such as defibrillation, cardiopulmonary resuscitation ("CPR"), surgery, or medication.

Many of the presently available gowns closeable by strings that are tied together can become knotted or tangled, thus preventing the healthcare professional from quickly and easily accessing the chest of the patient. Much valuable time is wasted when a healthcare professional struggles with knotted or tangled strings such as when the patient's heart rate must be obtained immediately after a treadmill test or such as when pictures or images must be obtained immediately after an echocardiogram test.

Additionally, one-size-fits-all gowns fail to sufficiently cover a woman with larger breasts. Although plus size gowns are available, these tend to be too long requiring a healthcare practitioner to move or lift excess material from the bottom making it difficult to access the patient's chest in a timely manner.

There is a demand for a garment that provides support and protection during a range of activities. More specifically, there is a demand for a patient gown that supports and protects the chest including breasts of a woman of any size, is quickly and easily removable, and maintains privacy and modesty of the patient. The present invention satisfies this demand.

SUMMARY OF THE INVENTION

For purposes of this application, the present invention is discussed in reference to a garmet worn during medical procedures, but the discussion is merely exemplary. Additionally, the present invention is discussed in reference to being worn by a woman, but it is contemplated the configurable supportive protection system and methods may be worn by a man.

The present invention is directed to a system and methods that provide support and protection to human body parts. Advantageously, the system is quickly and easily configurable to allow body parts having different sizes to be supported. The system is selectively openable to thereby facilitate the maintenance of privacy and modesty of the patient during any activity.

One embodiment of the present invention provides support and protection to the torso, chest including breasts, particularly of a woman, while enabling selective quick and easy access to the torso and chest such as during medical procedures by a healthcare professional. For purposes of this application, the term "thorax" or "chest" refers to the area of the body that lies between the head and the abdomen and includes the breasts. The term "torso" refers to the area of the body that lies between the head and the hips and includes the thorax and abdomen. A healthcare professional may include a physician, cardiac specialist, emergency room physician, sonographer, nurse, emergency medical technician, physician's assistant, nurse practitioner, or a medical procedure administrator, to name a few.

According to the present invention, the configurable supportive protection system includes a coverage element and a sizeable support element. The sizeable support element is positioned within the coverage element. The coverage element includes a seam opening element to allow access to the thorax of a patient as well as to allow access to the sizeable support element. In certain embodiments, the sizeable support element includes a joint opening element to allow access to the chest including the breasts.

It is contemplated that the configurable supportive protection system may be a length such that it does not get caught underneath the patient when they lay on the side or are sitting down such as a configurable supportive protection system that terminates at or about the hip (hip-length). It is also contemplated that the configurable supportive protection system may terminate at or about the knee (knee-length), calf (calf-length), or ankle (ankle-length). In certain embodiments, the configurable supportive protection system allows a patient to wear something over or on the legs such as shorts or pants.

The coverage element is positioned about a patient body and covers the torso. The coverage element includes an inside surface and an outside surface and may be constructed from a single continuous piece of material or portions of material that are connected such as by sewing. More specifically, the coverage element includes a back component connected to a front component. The front component further includes a left side component, a right side component and, in certain embodiments, one or more sleeve components.

In certain embodiments one of the left side component and right side component includes an overlap component. The overlap component allows the coverage element to accommodate various sized and/or shaped torsos, for example, the overlap component may extend beyond the front component to support and protect larger patients or may fold to the inside surface or outside surface of the coverage element to support and protect smaller patients. In other embodiments the back component of the coverage element may include an expandable ridge element to accommodate various sized and/or shaped torsos.

The coverage element may be made of any contemplated material such as cotton, nylon, polyester, spandex, LYCRA® fiber, paper, plastic, fleece, wool, or any combination thereof. It is further contemplated the coverage element may be made of a disposable material or a moisture wicking material. It is also contemplated that the coverage element may be made of a penetrable material such that radiation may penetrate or through which medical pictures or images may be taken such as x-ray.

The sizeable support element is positioned about a patient body and covers the thorax including the breasts. The sizeable support element includes an inside face and an outside face and may be constructed from a single continuous piece of material or portions of material that are connected such as by sewing. In one embodiment, the sizeable support element includes a front portion. In another embodiment, the sizeable support element includes a back portion connected to a front portion. The front portion may further include a left side portion and a right side portion. In certain embodiments, the left side portion and the right side portion of the sizeable support element may be of any shape and/or size, for example, to accommodate chests including breasts of varying configuration such as where one breast is smaller than the other.

It is also contemplated that the sizeable support element may further include a padding element for additional support, protection and cushion. In one embodiment, the padding element is additional material. In another embodiment, the padding element includes an insert element such as pads, tissue, fluff or cups that are inserted into a pocket element located within the sizeable support element. A padding element may be useful for woman concerned with the small size of their breasts including women who have had a mastectomy.

The sizeable support element may be made of any contemplated material such as cotton, nylon, polyester, spandex, Lycra® fiber, paper, plastic, fleece, wool, or any combination thereof, although in its preferred embodiment, the sizeable support element is adjustable such as made from an elastic or stretchable material to accommodate thoraxes including breasts of various sizes. It is further contemplated the sizeable support element may be made of a disposable material or a moisture wicking material. It is also contemplated that the sizeable support element may be made of a penetrable material such that radiation may penetrate or through which medical pictures or images may be taken such as x-ray.

The coverage element and sizeable support element may be unified in any number of ways. In one embodiment the sizeable support element is separate from the coverage element such that a patient first puts on the sizeable support element and then puts on the coverage element. It is also contemplated that sizeable support element may be releasably attached to the coverage element, for example at the shoulder portion, so that the coverage element and sizeable support element stay connected during a medical procedure. In another embodiment, it is contemplated that the sizeable support element is integrated, or fixedly attached, to the coverage element via attaching components such as stitch sewn together, although any attaching components are contemplated that integrate the coverage element and sizeable support element.

The coverage element includes a seam opening element to releasably open the coverage element allowing access to the thorax of a patient as well as allowing access to the sizeable support element. The seam opening element may further include one or more fastening components to facilitate the opening and closing of the coverage element. Fastening components include, for example, sewn stitches, hook and loop fasteners, snaps, buttons, strings, zippers, tape or any combination thereof. It should be noted that any configuration of attachment component is contemplated. In one embodiment, fastening components are positioned anywhere along the front component of the coverage element including off-center, such as along a left-center which is approximate to the position of the patient's heart. It is also contemplated that the fastening components are positioned anywhere along the back component of the coverage element.

The sizeable support element includes a joint opening element to open the sizeable support element allowing access to the chest, particularly the breasts. The joint opening element may further include one or more securing components to facilitate opening and closing of the sizeable support element. Securing components include, for example, sewn stitches, hook and loop fasteners, snaps, buttons, strings, zippers, tape or any combination thereof. It should be noted that any configuration of attachment component is contemplated. In one embodiment, securing components are positioned anywhere along the front portion of the sizeable support element including off-center, such as along a left-center which is approximate to the position of the patient's heart. It is also contemplated that the securing components may be positioned anywhere along the back portion of the sizeable support element.

One object of the present invention is to provide a configurable supportive protection system and methods which provides support and protection, allows easy access to the chest, and is generally more comfortable for the female patient.

It is an object of the invention to provide a configurable supportive protection system and methods that is configurable to provide support and protection to patients of a wide range of sizes.

It is another object of the invention to provide a configurable supportive protection system and methods that provides support and protection to various sized and/or shaped breasts including larger breasts.

It is another object of the invention to provide a configurable supportive protection system and methods that may reduce pain and discomfort during medical procedures including those that require exercise.

It is yet another object of the invention to provide a configurable supportive protection system and methods that allows some part of the patient's body to be exposed while other parts of the body covered.

It is another object of the invention to provide a configurable supportive protection system and methods that allows access to the torso and thorax to perform treatments, tests or examinations including the use of various medical procedure equipment.

It is another object of the invention to provide a configurable supportive protection system and methods that may alleviate falsified results including, for example, artifacts on an imaging device.

It is another object of the invention to provide a configurable supportive protection system and methods that allows access the chest to quickly and easily.

Another object of the present invention is to provide a configurable supportive protection system and methods that is penetrable, for example, that an x-ray of a patient's torso can be accomplished without removal of the garment.

It is a further object of the present invention to provide a configurable supportive protection system and methods that is suited for all activities of the patient's typical day, including examination, exercise, stress testing, resting, and hobby or other recreational activities, while allowing selectively adjustable fit, so that each patient need not be separately fitted with the garment.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will be described in conjunction with the appended drawings provided to illustrate and not to the limit the invention, where like designations denote like elements, and in which.

DESCRIPTION OF PREFERRED EMBODIMENTS

Figure 1:
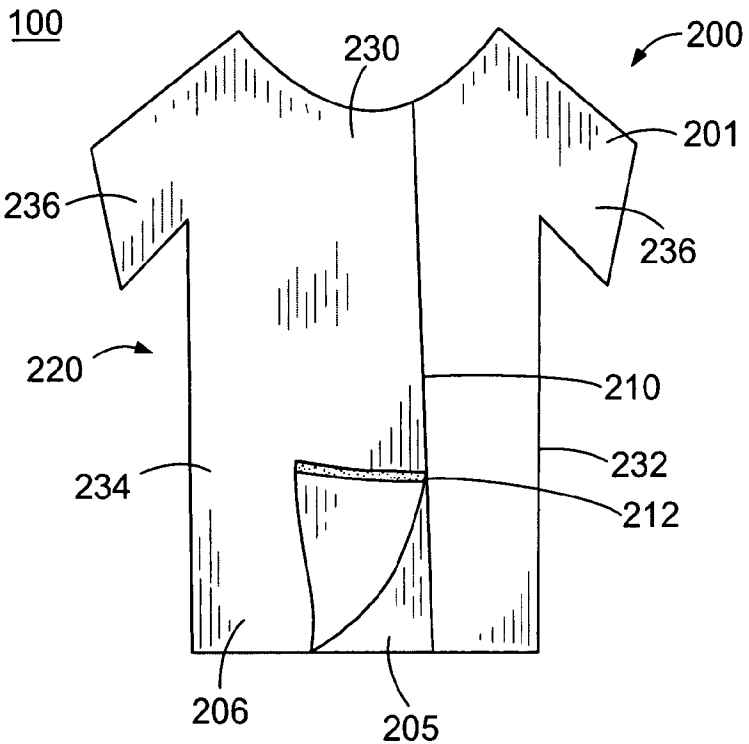
FIG. 1 illustrates one embodiment of a coverage element of the configurable supportive protection system according to the present invention.

FIG. 1 illustrates an embodiment 201 of the coverage element 200 of the configurable supportive protection system 100 according to the present invention. The coverage element 200 is positioned about a patient body and covers the torso. The coverage element 200 includes an inside surface 205 and an outside surface 206 and may be constructed from a single continuous piece of material or portions of material that are connected such as by sewing. More specifically, the coverage element 200 includes a back component 220 connected to a front component 230. The front component 230 further includes a left side component 232, a right side component 234 and, as shown in this embodiment, two sleeve components 236. The coverage element 200 is made of cotton, but any material is contemplated such as nylon, polyester, spandex, LYCRA® fiber, paper, plastic, fleece, wool, or any combination thereof.

Figure 3:
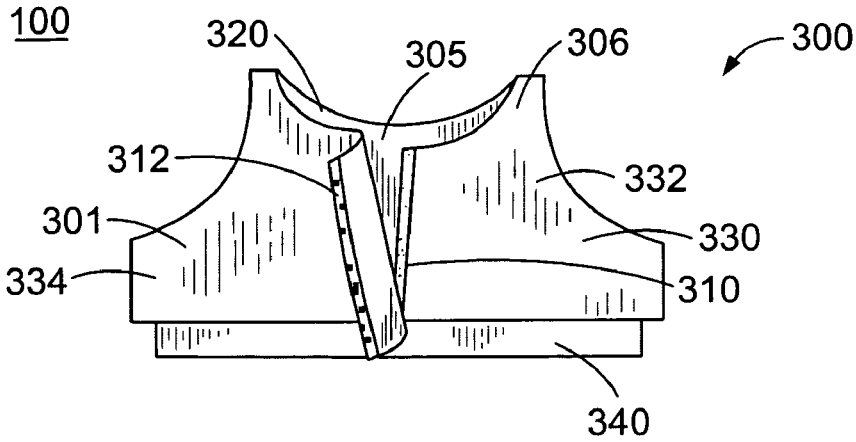
FIG. 3 illustrates one embodiment of a sizeable support element of the configurable supportive protection system according to the present invention.
Figure 4:
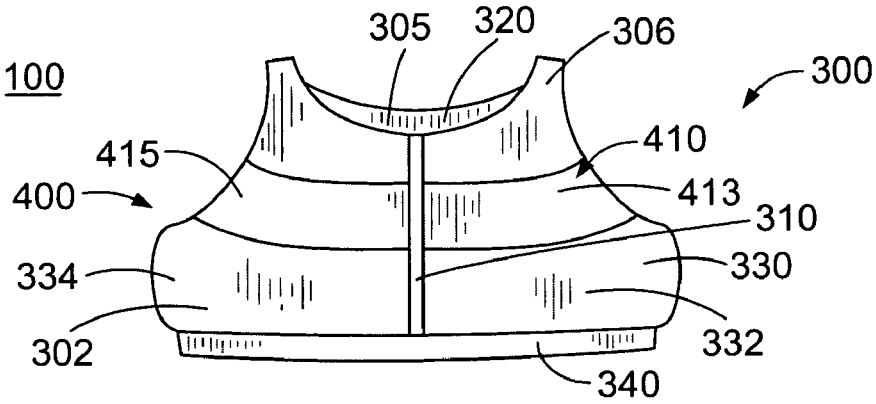
FIG. 4 illustrates another embodiment sizeable support element of the configurable supportive protection system according to the present invention.
Figure 5:
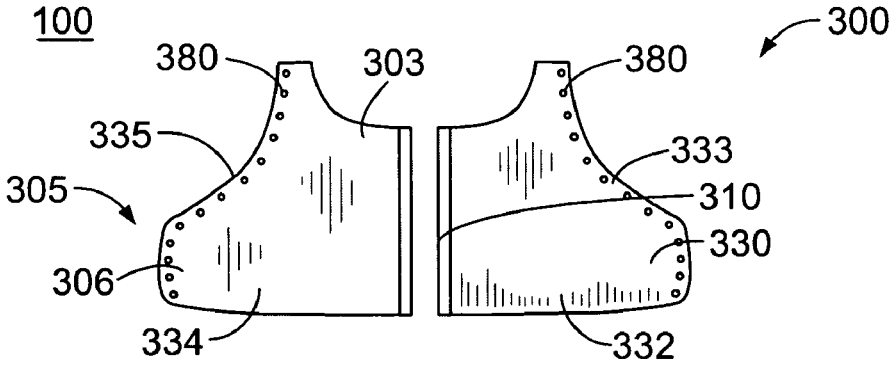
FIG. 5 illustrates another embodiment sizeable support element of the configurable supportive protection system according to the present invention.

The coverage element 200 includes a seam opening element 210 to allow access to the torso of a patient as well as to allow access to the sizeable support element 300 shown in FIG. 3 through FIG. 5. The seam opening element 210 further includes one or more fastening components 212 to facilitate closure of the seam opening element 210. As shown, fastening components 212 hook and loop fasteners, but any fastening component is contemplated such as snaps, buttons, strings, zippers, tape or any combination thereof. As shown, the fastening components 212 are positioned off-center, more specifically left-center, along the front component 230 of the coverage element 200 which is approximate to the position of the patient's heart.

Figure 2:
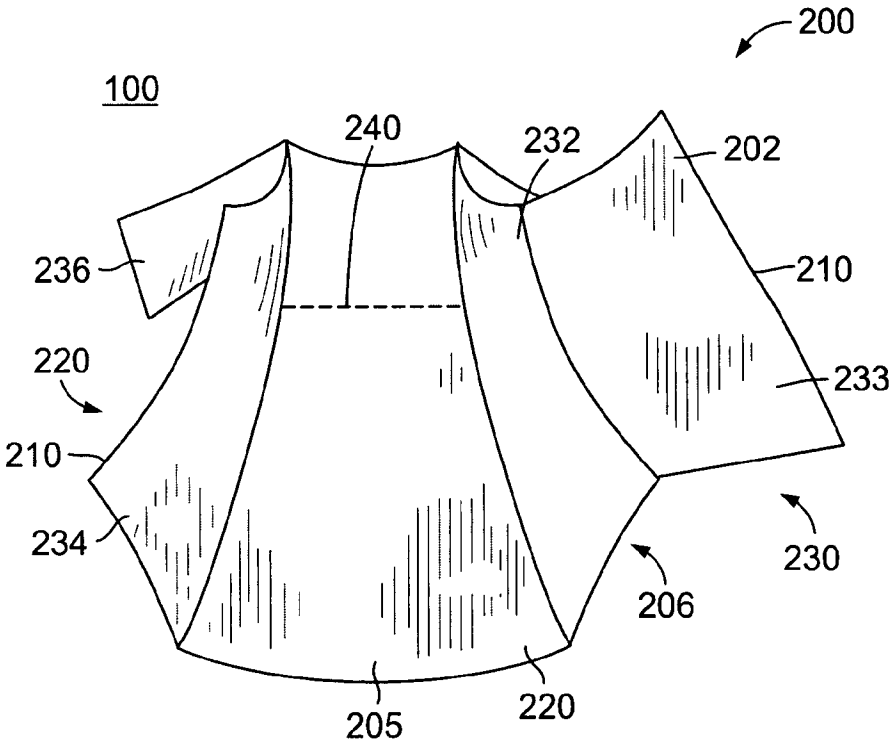
FIG. 2 illustrates another embodiment of a coverage element of the configurable supportive protection system according to the present invention.

FIG. 2 illustrates another embodiment 202 of a coverage element 201. As shown, the left side component 232 includes an overlap component 233, although it is contemplated that the right side component 234 may include the overlap component 233. The overlap component 233 allows the coverage element 201 to accommodate various sized and/or shaped torsos. The overlap component 233 may extend beyond the front component 230 including right side component 234 to support and protect larger patients or may fold to the inside surface 205 or outside surface 206 of the coverage element 201 to support and protect smaller patients. In other embodiments, the back component 220 may include an expandable ridge element as shown by 240 to accommodate various sized and/or shaped torsos.

In the preferred embodiment, the configurable supportive protection system 100 is hip-length, but it is also contemplated that the configurable supportive protection system 100 may be knee-length, calf-length, or ankle-length.

FIG. 3 illustrates an embodiment 301 sizeable support element 300 of the configurable supportive protection system 100 according to the present invention. The sizeable support element 300 is positioned about a patient body and covers the thorax including the breasts. The sizeable support element 300 includes an inside face 305 and an outside face 306 and may be constructed from a single continuous piece of material or portions of material that are connected such as by sewing. As shown in FIG. 3, the sizeable support element 300 includes a back portion 320 connected to a front portion 330. In certain embodiments, the sizeable support element includes only a front portion (see FIG. 5). The front portion 330 further includes a left side portion 332 and a right side portion 334. The left side portion 332 and the right side portion 334 of the sizeable support element 300 may be of any shape and/or size, for example, to accommodate breasts of varying configuration such as where one breast is smaller than the other. The sizeable support element 300 is made of a flexible material such as LYCRA® fiber, but any material is contemplated such as nylon, polyester, spandex, paper, plastic, fleece, wool, or any combination thereof.

The sizeable support element 300 includes a joint opening element 310 to allow access to the chest, particularly the breasts. The joint opening element 310 may further include one or more securing components 312 to facilitate opening and closing of the sizeable support element 300. As shown, securing components 312 are hook and loop fasteners, but any securing component is contemplated such as snaps, buttons, strings, zippers, tape or any combination thereof. As shown, the securing components 312 are positioned in-center along the front portion 330, but it is contemplated the securing components 312 can be off-center such as left-center, along the front portion 300 of the sizeable support element 300. In certain embodiments, the sizeable support element 300 further includes a band element 340 for additional support as shown in FIG. 3 and FIG. 4.

It is also contemplated that an embodiment 302 of the sizeable support element 300 as shown in FIG. 4 may further include a padding element 400 for additional support, protection and cushion. The padding element 400 may be additional material but is shown to include pocket element 410 into which a padding element (not shown) such as pads, tissue, fluff or cups are inserted. More specifically, the left side portion 332 and right side portion 334 include a first pocket element 413 and a second pocket element 415 respectively.

In certain embodiments such as the embodiment 303 shown in FIG. 5, the sizeable support element 300 includes only a front portion 330 as shown in FIG. 5. In embodiments where the sizeable support element 302 only includes a front portion 330, the left side portion 332 terminates at a left lateral side 333 and the right side portion 334 terminates at a right lateral side 335. In the embodiment shown in FIG. 5, the sizeable support element 302 is integrated with the coverage element 200 via attaching components 380 positioned on the lateral sides 333, 335. In one embodiment, the attaching components 380 are such that the sizeable support element 302 is stitch sewn into the coverage element 200 (see FIG. 7). As mentioned above, the left side portion 332 and the right side portion 334 of the sizeable support element 300 may be of any shape and/or size, for example, to accommodate breasts of varying configuration such as where one breast is smaller than the other.

Figure 6:
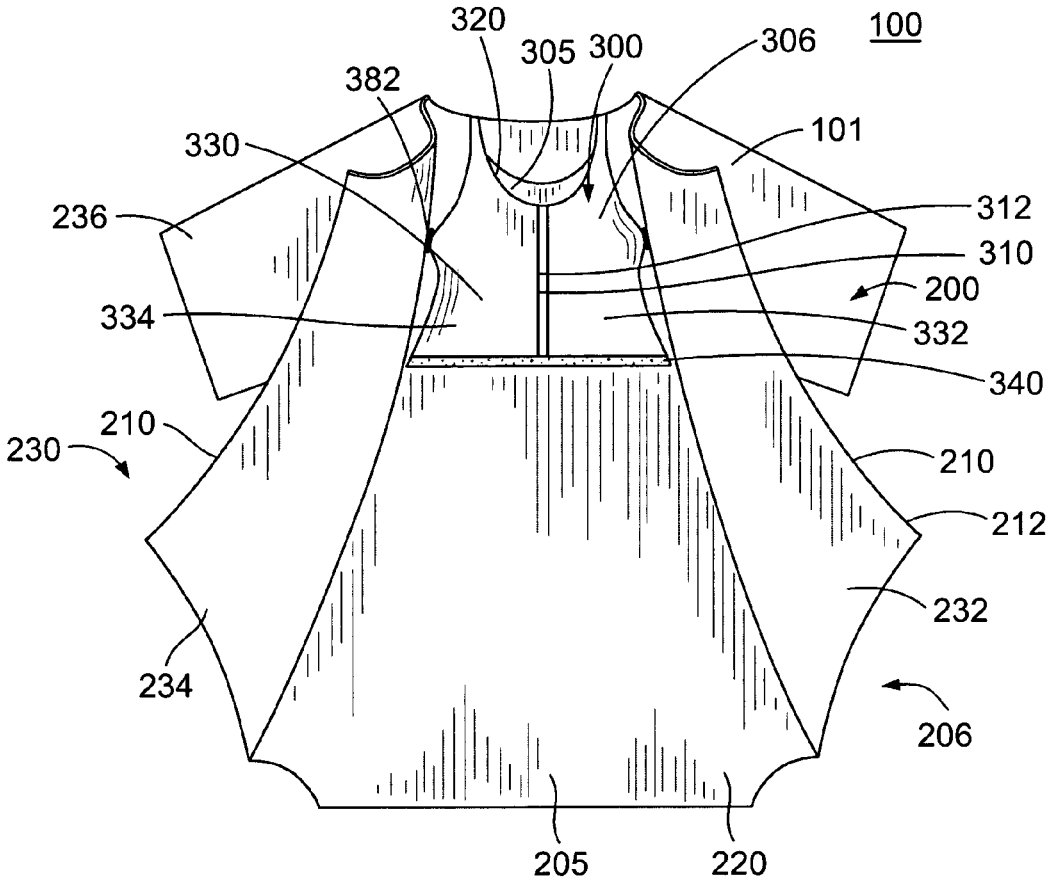
FIG. 6 illustrates one embodiment of the configurable supportive protection system according to the present invention.

The coverage element 300 and sizeable support element 200 may be unified in any number of ways. As shown by the embodiment 101 of the configurable supportive protection system 100 in FIG. 6, the coverage element 200 and sizeable support element 300 are integrated, or fixedly attached, via attaching component 382 such as snaps. It is contemplated that the attaching component 382 may be positioned anywhere such that the outside face 306 of the sizable sizeable support element 300 substantially abuts the inside surface 205 of the coverage element 200.

In another embodiment the sizeable support element 300 is separate from the coverage element 200 such that a patient first puts on the sizeable support element 300 and then puts on the coverage element 200. It is also contemplated that sizeable support element 300 may be releasably attached to the coverage element 200, for example at the shoulder portion, so that the coverage element 200 and sizeable support element 300 stay connected during a medical procedure.

Figure 7:
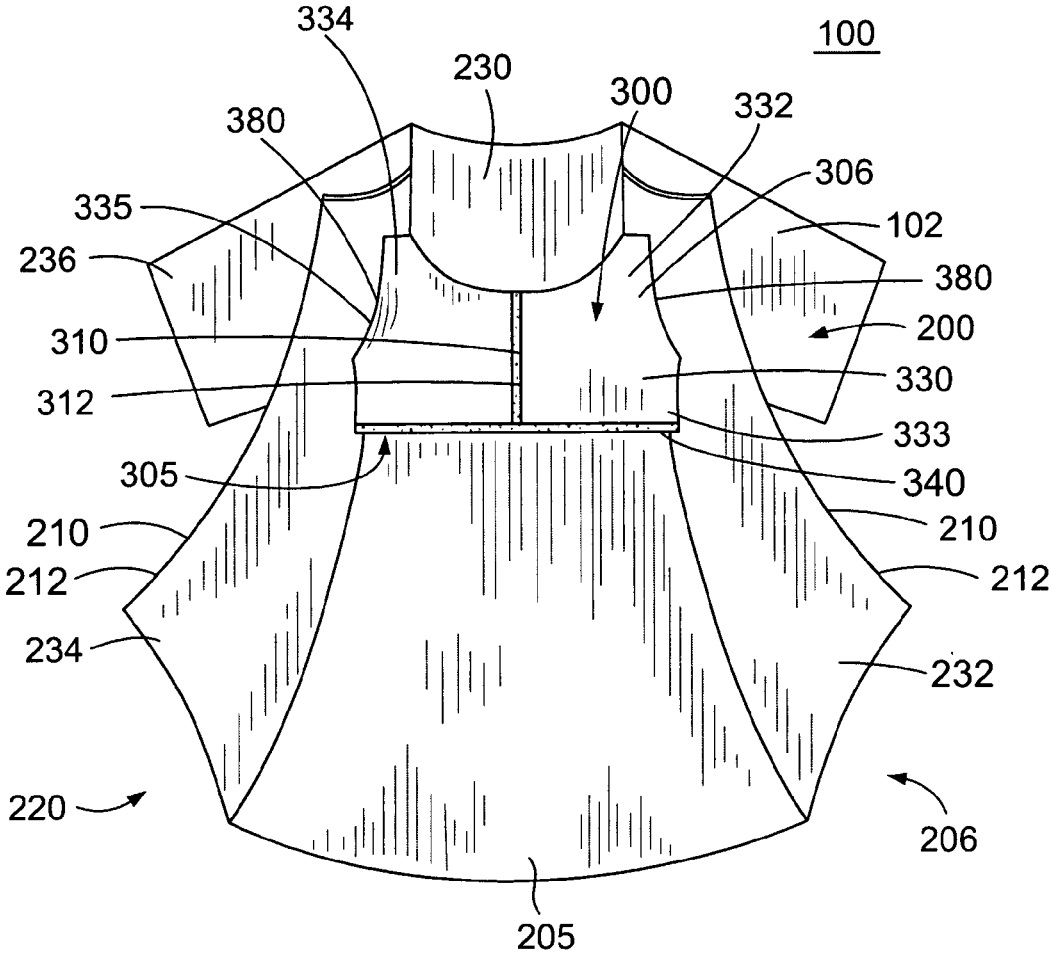
FIG. 7 illustrates another embodiment of the configurable supportive protection system according to the present invention.

FIG. 7 shows another embodiment 102 of the configurable supportive protection system 100 comprising the coverage element 200 and sizeable support element 300 according to the present invention. In this embodiment 102, the sizeable support element 200 includes a front portion 330 as described in reference to FIG. 5 above. The sizeable support element 300 is integrated with the coverage element 200 via stitch sewn attaching components 380 positioned on the lateral sides 333, 335.

It will be understood that the embodiments of the present invention which have been described are illustrative of some of the applications of the principles of the present invention. Numerous modifications may be made by those skilled in the art without departing from the true spirit and scope of the invention.

What is claimed is:

1. A configurable supportive protection system for a patient, comprising:

a sizeable support element sized and shaped to cover a breast area of the patient;

a coverage element including an inside surface, an outside surface, and a seam opening element, said seam opening element operable to provide a closed state and an open state, wherein in the closed state, said inside surface is continuous, said outside surface is continuous, and said coverage element provides coverage of most or all of said sizeable support element and at least the patient's torso, and wherein in the open state, said inside surface is discontinuous, said outside surface is discontinuous, and parts of the patient's torso not covered by the sizeable support element are exposed for medical procedures while maintaining the patient's privacy and modesty.

2. The configurable supportive protection system of claim 1, wherein said seam opening element is on said front component of said coverage element.

3. The configurable supportive protection system of claim 1, wherein said joint opening element is on said front portion of said sizeable support element.

4. The configurable supportive protection system of claim 1, wherein said coverage element is releasably attached to said sizeable support element.

5. The configurable supportive protection system of claim 1, wherein said coverage element is fixedly attached to said sizeable support element.

6. The configurable supportive protection system of claim 1, wherein said seam opening element further includes a fastening component.

7. The configurable supportive protection system of claim 1, wherein said joint opening element further includes a securing component.

8. The configurable supportive protection system of claim 2, wherein said seam opening element is positioned along a left-center which is approximate to a patient's heart.

9. The configurable supportive protection system of claim 3, wherein said joint opening element is positioned along a left-center which is approximate to a patient's heart.

10. The configurable supportive protection system of claim 1, wherein said sizeable support element further comprises a padding element.

11. The configurable supportive protection system of claim 10, wherein said padding element further includes a pocket element into which insert elements are positioned.

12. The configurable supportive protection system of claim 1, wherein said sizeable support element and said coverage element are made out of x-ray penetrable material.

13. The configurable supportive protection system of claim 1, wherein said sizeable support element further comprises a left side portion and a right side portion.

14. The configurable supportive protection system of claim 13, wherein said left side portion and said right side portion are separable from each other by a joint opening element, said left side portion and said right side portion sized and shaped to accommodate breasts of varying configurations.

15. The configurable supportive protection system of claim 6, wherein said fastening component is hook and loop fasteners.

16. The configurable supportive protection system of claim 7, wherein said securing component is hook and loop fasteners.

17. The configurable supportive protection system of claim 1, wherein said back component of said coverage element includes an expandable ridge element.

18. The configurable supportive protection system of claim 1, wherein said front component of said coverage element further includes an overlap component.

* * * * *